US009259762B2

(12) United States Patent
Mizuno

(10) Patent No.: US 9,259,762 B2
(45) Date of Patent: Feb. 16, 2016

(54) BUILDING BOARD AND METHOD FOR MANUFACTURING THE SAME

(75) Inventor: Daizou Mizuno, Nagoya (JP)

(73) Assignee: NICHIHA CORPORATION, Nagoya-Shi (JP)

( * ) Notice: Subject to any disclaimer, the term of this patent is extended or adjusted under 35 U.S.C. 154(b) by 738 days.

(21) Appl. No.: 13/403,337

(22) Filed: Feb. 23, 2012

(65) Prior Publication Data

US 2012/0251787 A1 Oct. 4, 2012

(30) Foreign Application Priority Data

Mar. 31, 2011 (JP) ..... JP2011-077724

(51) Int. Cl.

| | |
|---|---|
| ***B05D 3/12*** | (2006.01) |
| ***B44F 9/02*** | (2006.01) |
| ***B44C 5/04*** | (2006.01) |
| *B05D 5/06* | (2006.01) |
| *B44C 3/00* | (2006.01) |

(52) U.S. Cl.

CPC ... *B05D 3/12* (2013.01); *B44C 5/04* (2013.01); *B44F 9/02* (2013.01); *B05D 5/061* (2013.01); *B44C 3/005* (2013.01); *B44C 5/0461* (2013.01); *Y10T 428/24554* (2015.01)

(58) Field of Classification Search

None

See application file for complete search history.

(56) References Cited

U.S. PATENT DOCUMENTS

| | | | | |
|---|---|---|---|---|
| 3,811,915 | A | 5/1974 | Burrell et al. | |
| 3,847,646 | A * | 11/1974 | Daunheimer et al. | 427/368 |
| 4,743,475 | A * | 5/1988 | Negri et al. | 427/387 |
| 6,012,255 | A | 1/2000 | Smid et al. | |
| 2003/0031796 | A1* | 2/2003 | Prosser | 427/280 |
| 2008/0010924 | A1 | 1/2008 | Pietruczynik et al. | |
| 2008/0050556 | A1* | 2/2008 | Van Elten | 428/114 |
| 2010/0080970 | A1* | 4/2010 | Hayes et al. | 428/209 |
| 2011/0059239 | A1 | 3/2011 | Oldorff | |

FOREIGN PATENT DOCUMENTS

| | | | |
|---|---|---|---|
| JP | 58-118289 | A | 7/1983 |
| JP | 61-39163 | B2 | 8/1986 |
| JP | 1-146044 | A | 6/1989 |
| JP | 2004-232237 | A | 8/2004 |
| JP | 2004-353299 | A | 12/2004 |
| JP | 2006-159089 | A | 6/2006 |

* cited by examiner

*Primary Examiner* — Timothy Meeks
*Assistant Examiner* — Michael P Rodriguez
(74) *Attorney, Agent, or Firm* — Birch, Stewart, Kolasch & Birch, LLP

(57) ABSTRACT

A building board includes an undercoat coating, an overcoat coating having lower pigment content than the undercoat coating and having different hue from the undercoat coating and having variations in position and thickness, an inkjet coating having different hue from the overcoat coating and is applying partially, and a clear coating successively formed on surface of inorganic base material having a plurality of wood board patterns. There also is provided a method for manufacturing a building board including the steps of applying an undercoat paint to surface of inorganic base material having a plurality of wood board patterns, applying an overcoat paint having lower pigment weight concentration than the undercoat paint and having different hue from the undercoat paint, scraping off a part of the applied overcoat paint before the overcoat paint cures, partially applying inkjet painting having different hue from the overcoat paint, and applying a clear paint.

7 Claims, 2 Drawing Sheets

BUILDING BOARD AND METHOD FOR MANUFACTURING THE SAME

BACKGROUND OF THE INVENTION

1. Field of the Invention

The present invention relates to building boards that constitute exterior and interior walls of buildings.

2. Description of the Related Art

Conventionally, construction of exterior and interior walls of buildings by installing a plurality of building boards to a structural building frame of a building has been performed. For this purpose, attempts have been made to improve the design by, for example, providing a pattern of deep irregularities on the surface of a building board. For example, JP 2004-353299A discloses a building board that is manufactured by forming a wood grain pattern on the surface of a building board and that presents a wood grain design and appearance, as well as a manufacturing method therefor.

However, recently, there has been a demand for a building board that more closely resembles wood and that presents a three-dimensional appearance. Thus, the inventor of the present invention has conducted intensive research on a building board that closely resembles wood and that presents a three-dimensional appearance and a manufacturing method therefor.

SUMMARY OF THE INVENTION

It is an object of the present invention to provide a building board that closely resembles wood and that presents a three-dimensional appearance and a manufacturing method therefor.

The present invention provides a building board including an inorganic base material having a plurality of wood board patterns on a surface thereof, and an undercoat coating, an overcoat coating, an inkjet coating, and a clear coating successively formed on the surface of the inorganic base material. In the building board of the present invention, the undercoat coating and the overcoat coating contain a pigment, the undercoat coating has a higher pigment content than that of the overcoat coating, and the undercoat coating and the overcoat coating have different hues. The wood board patterns have different depths of color due to variations in the position and the thickness of the overcoat coating, and the wood board patterns have different hues due to partial arrangement of the inkjet coating having a different hue from the overcoat coating. These features allow the building board of the present invention to closely resemble wood and present a three-dimensional appearance.

It should be noted that an inorganic base material refers to a ceramic-based siding board such as a wood fiber-reinforced cement board, a fiber-reinforced cement board, a fiber-reinforced cement calcium silicate board, or a slag gypsum board, a metal-based siding board, an ALC board, or the like, and the inorganic base material has a plurality of wood board patterns on its surface. These wood board patterns are patterns designed to look like a plurality of boards of wood joined together. It is possible to obtain a building board having excellent flexural strength, weatherproofness, and sound insulating properties by using such an inorganic base material. It is preferable that the inorganic base material has at least a wood board pattern in which a saw blade pattern is provided because a look that more closely resembles wood can be obtained and the resulting position and thickness of the overcoat coating vary widely due to the saw blade pattern. It should be noted that the saw blade pattern can be formed of streaky recesses and protrusions, and it is preferable that a plurality of saw blade patterns are formed at intervals on a single wood board pattern because the resulting effect of the saw blade patterns becomes significant.

The undercoat coating, the overcoat coating, and the clear coating are composed of a synthetic resin such as acrylic resin, silicone resin, fluororesin, silicone acrylic resin, polyurethane resin, or epoxy resin. It is preferable that these coatings are composed of a highly waterproof resin such as cyclohexamethacrylate or silicone acryl because more excellent weatherproofness can be achieved. Furthermore, it is preferable that the clear coating is composed of an organic-inorganic composite paint because even more excellent weatherproofness can be achieved. The inorganic base material may have minute pores on its surface, and it is therefore preferable that the undercoat coating contains a filler such as calcium carbonate, clay, or acrylic beads because the pores of the inorganic base material are then filled with the filler and water absorption through the surface can be prevented. It is preferable that the clear coating contains matte beads, a light stabilizer, and an ultraviolet absorber because the resulting clear coating has cushioning characteristics and also ultraviolet degradation and light degradation thereof can be suppressed.

Furthermore, it is preferable that the undercoat coating is formed of a paint having a pigment weight concentration (PWC) of 40 to 60% and the overcoat coating is formed of a paint having a lower pigment weight concentration (PWC) than that of the paint that forms the undercoat coating because the best look with regard to color can be obtained and a more three-dimensional appearance can be presented. Although the overcoat coating preferably is formed of a paint having a pigment weight concentration (PWC) of 15 to 35%, the overcoat coating may be formed of a colored clear paint depending on the finishing color.

Furthermore, it is preferable that there is a portion in which the undercoat coating is seen through the overcoat coating because an infinite gradation of density can be obtained as the depth of color. The same effect can be obtained even when the overcoat coating is a colored clear coating.

Moreover, it is preferable that there is a portion in which the overcoat coating is absent on the undercoat coating because the resulting hue varies more widely and a look containing variations in the hue ranging from drastic to subtle can be obtained.

Furthermore, the present invention also provides a method for manufacturing a building board having on its surface a design that resembles a plurality of boards of wood joined together. The manufacturing method of the present invention includes the steps of applying an undercoat paint to a surface of an inorganic base material having a plurality of wood board patterns on the surface thereof, applying an overcoat paint, scraping off a part of the applied overcoat paint before the overcoat paint cures, performing inkjet painting, and applying a clear paint. The undercoat paint has a pigment weight concentration (PWC) of 40 to 60%, and the overcoat paint has a lower pigment weight concentration (PWC) than that of the undercoat paint. Although the overcoat paint preferably has a pigment weight concentration (PWC) of 15 to 35%, the overcoat paint may be a colored clear paint depending on the finishing color. Moreover, in the steps of applying the overcoat paint and scraping off a part of the applied overcoat paint, the overcoat paint having a different hue from the undercoat paint is applied and the position and the amount of the overcoat paint applied are varied to make differences in the depth of color among the wood board patterns. It should be noted that in the step of scraping off a part of the overcoat paint, a scraper such as a rubber roller is brought into contact with the overcoat paint before curing and the overcoat paint is scraped off, and it is preferable that the scraper is moved in the same direction as the direction in which the board is conveyed because the scraping operation can be performed smoothly. In the step of performing inkjet painting, inkjet painting with a different hue from the overcoat paint is partially performed, thereby causing the wood board patterns to have different hues. Thus, a building board that closely resembles wood and that presents a three-dimensional appearance can be manufactured.

It should be noted that the inorganic base material is as described above, and it is preferable that the inorganic base material has at least a wood board pattern in which a saw blade pattern is provided because a look that more closely resembles wood can be obtained, and even when the scraper is brought into contact with the applied overcoat paint and the overcoat paint is uniformly scraped off, how the overcoat paint is scraped off varies, and the position and the amount of the overcoat paint applied in the wood board pattern varies drastically. It should be noted that the saw blade pattern can be formed of streaky recesses and protrusions, and it is preferable that a plurality of saw blade patterns are formed at intervals on a single wood board pattern because the resulting effect of the saw blade patterns becomes significant.

Moreover, it is preferable that a portion in which the undercoat coating is seen through the overcoat coating is formed by the step of scraping off a part of the overcoat paint because an infinite gradation of density can be obtained as the depth of color. It also is preferable that a colored clear paint is used as the overcoat paint because the same effect can be obtained. It is preferable that a portion in which the overcoat coating is absent is formed by the step of scraping off a part of the overcoat paint because the resulting hue varies more widely and a look containing variations in the hue ranging from drastic to subtle can be obtained.

Furthermore, it is preferable that a paint that dries more slowly than the undercoat paint is used as the overcoat paint because scraping off of the overcoat paint can be performed easily.

Furthermore, it is preferable that a paint containing a filler such as calcium carbonate, clay, or acrylic beads is used as the undercoat paint because, when the inorganic base material has pores on its surface, the pores are then filled with the filler and water absorption through the surface can be prevented. It is preferable that a paint containing matte beads, a light stabilizer, and an ultraviolet absorber is used as the clear paint because the resulting clear coating has cushioning characteristics and also ultraviolet degradation and light degradation thereof can be suppressed.

According to the present invention, it is possible to provide a building board that closely resembles wood and that presents a three-dimensional appearance and a manufacturing method therefor.

DESCRIPTION OF THE PREFERRED EMBODIMENTS

Next, embodiments of the present invention will be described.

Figure 1:
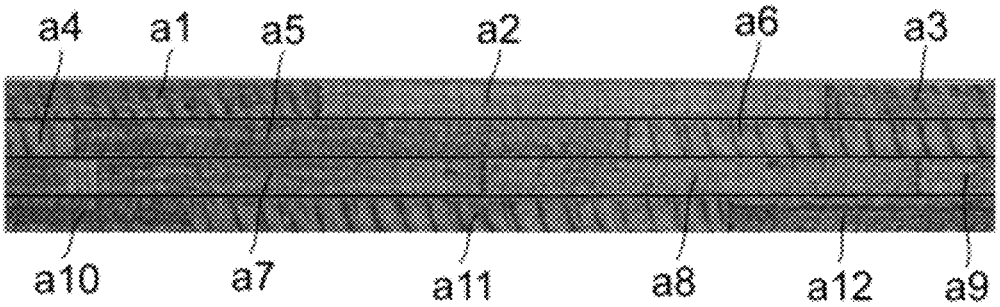
FIG. 1 is a front view of a building board according to the present invention.

FIG. 1 is a front view of a building board according to the present invention. A building board A1 includes, as a base material, an inorganic board having on its surface a pattern designed to look like boards of wood joined together. Specifically, wood board patterns a1 to a12 are arranged and formed on the surface of the inorganic board as if they are joined together with a recessed groove interposed between them, and the wood board patterns a1 to a12 have different surface irregularities and different wood board pattern lengths. Moreover, the wood board patterns a1 to a12 are provided with saw blade patterns, which impart a wide variety of irregularities to the wood board patterns a1 to a12. More specifically, in the wood board pattern a1, a plurality of saw blade patterns are provided by forming a plurality of deep, wide, streaky recesses obliquely at intervals. In the wood board pattern a2, a plurality of saw blade patterns are provided by forming a plurality of shallow, narrow, streaky recesses vertically at intervals. In the wood board pattern a3, a plurality of saw blade patterns are provided by forming a plurality of shallow streaky recesses obliquely at intervals. In the wood board pattern a4, a plurality of saw blade patterns are provided by forming a plurality of deep, wide, streaky recesses obliquely at intervals. In the wood board pattern a5, a plurality of saw blade patterns are provided by forming a plurality of shallow streaky recesses obliquely at intervals. In the wood board pattern a6, a plurality of saw blade patterns are provided by forming a plurality of deep, wide, streaky recesses obliquely at intervals. In the wood board pattern a7, a plurality of saw blade patterns are provided by forming a plurality of shallow, narrow, streaky recesses vertically at intervals. In the wood board pattern a8, a plurality of saw blade patterns are provided by forming a plurality of shallow, narrow, streaky recesses obliquely at intervals. In the wood board pattern a9, a plurality of saw blade patterns are provided by forming a plurality of shallow, narrow, streaky recesses vertically at intervals. In the wood board pattern a10, a plurality of saw blade patterns are provided by forming a plurality of shallow, narrow, streaky recesses obliquely at intervals. In the wood board pattern a11, a plurality of saw blade patterns are provided by forming a plurality of deep, wide, streaky recesses obliquely at intervals. In the wood board pattern a12, a plurality of saw blade patterns are provided by forming a plurality of shallow streaky recesses obliquely. That is to say, in the wood board patterns, saw blade patterns of various depths and shapes are provided.

To the surface of this inorganic board, about 10 g/(30.3 cm)$^2$ of a highly weatherproof acrylic emulsion paint containing a pigment at a PWC of about 50% was applied as an undercoat paint and dried with a dryer. Subsequently, about 8 g/(30.3 cm)$^2$ of a highly weatherproof acrylic emulsion paint containing acrylic beads and a pigment at a PWC of about 30% and having a different hue from the undercoat paint was applied to the surface as an overcoat paint. Then, before the overcoat paint cured, a rubber roller was brought into contact with the overcoat paint and rotated in the same direction as the direction in which the board was conveyed (conveyance direction), thereby scraping off the overcoat paint. As described above, since the wood board patterns a1 to a12 are provided with a plurality of saw blade patterns of various depths and shapes, even when the overcoat paint is scraped off uniformly, how the overcoat paint is scraped off varies, and therefore, in the wood board patterns a1 to a12, the position and the amount of the overcoat paint applied vary drastically. Then, after drying with a dryer, inkjet painting with a different hue from the overcoat paint was applied to the dried surface of the wood board patterns a1, a3, a5, and a10 and dried with a dryer. Furthermore, about 8 g/(30.3 cm)$^2$ of a highly weatherproof clear paint containing acrylic beads was applied to the dried surface, followed by drying with a dryer to obtain the building board A1.

As described above, since the undercoat paint and the overcoat paint are applied to the surface of the inorganic board having on its surface the wood board patterns a1 to a12 in which a plurality of saw blade patterns of various depths and shapes are provided, and the overcoat paint is scraped off, the position and the amount of the overcoat paint applied vary drastically, presenting a three-dimensional appearance. Moreover, since inkjet painting is applied to the wood board patterns a1, a3, a5, and a10, the hue varies widely. Furthermore, as can be seen from the wood board patterns a2, a4, a6, a7, a8, a9, and a11, since there are portions where the undercoat coating is seen through the overcoat coating and portions where the overcoat coating is absent on the undercoat coating, the depth of color varies widely.

Figure 2:
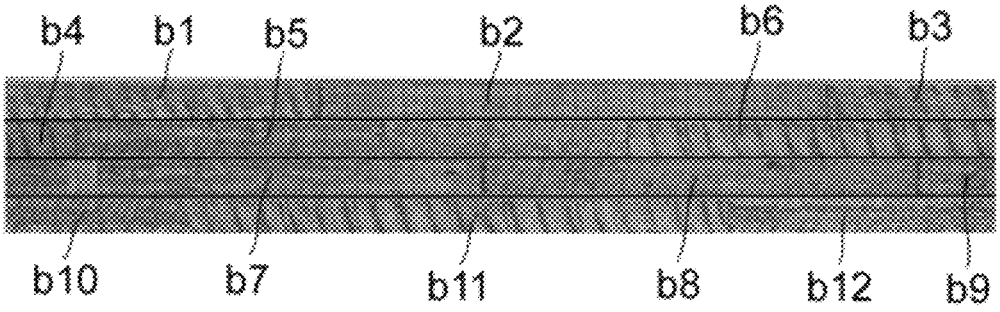
FIG. 2 is a front view of another building board according to the present invention.

FIG. 2 is a front view of another building board according to the present invention. A building board A2 also includes the same inorganic board as that in FIG. 1 as a base material. That is to say, wood board patterns b1 to b12 formed on the surface of the inorganic board are the same as the wood board patterns a1 to a12, and a plurality of saw blade patterns of various depths and shapes are provided therein.

The building board was obtained by painting the inorganic board in the same manner as the building board shown in FIG. 1 except that a highly weatherproof clear paint containing acrylic beads and a pigment at a PWC of about 0.5% was applied to the surface of the inorganic board as the overcoat paint. However, in this building board as well, since the undercoat paint and the overcoat paint are applied to the inorganic board having on its surface the wood board patterns b1 to b12 in which a plurality of saw blade patterns of various depths and shapes are provided, and the overcoat paint is scraped off, the position and the amount of the overcoat applied vary drastically. In particular, since a colored clear paint is used as the overcoat paint, the undercoat coating is seen through the overcoat coating, the depth of the color varies widely, and a three-dimensional appearance is presented. Moreover, since inkjet painting is applied, the hue varies widely.

Although embodiments of the present invention have been described above, the present invention is not limited to the above embodiments and can be implemented in various modified forms that fall within the scope of the invention as set forth in the appended claims.

As described above, according to the present invention, it is possible to provide a building board that closely resembles wood and that presents a three-dimensional appearance and a manufacturing method therefor.

What is claimed is:

1. A method for manufacturing a building board having on an upper surface thereof a plurality of wood board patterns containing a horizontal, linearly arranged recessed groove for separating at least two of the plurality of the wood board patterns and a plurality of obliquely formed grooved recessed portions for forming the plurality of wood board patterns on the upper surface of the inorganic base material, the method comprising the steps of:

providing an inorganic base material having said horizontal, linearly arranged recessed groove for separating at least two of the plurality of the wood board patterns and said plurality of obliquely formed grooved recessed portions for forming the plurality of wood board patterns on the upper surface of the inorganic base material, conveying the inorganic base material through a painting process comprising:

applying an undercoat paint to the upper surface of the inorganic base material; and applying an overcoat paint on the undercoat paint, wiping off a part of the applied overcoat paint from the upper surface of the inorganic base material by a roller before the overcoat paint cures, while conveying the inorganic base material, wherein the applied overcoat paint is wiped off from the upper surface of the inorganic base material by rotating the roller in the same direction as the direction in which the inorganic base material is conveyed, drying the overcoat paint by a dryer, after drying the overcoat paint by the dryer, performing inkjet painting to the upper surface of an inorganic base material, so that a different hue is formed by partially applying an ink having a different hue from that of the overcoat paint by inkjet printing, and applying a clear paint; wherein the undercoat paint has a pigment weight concentration (PWC) of 40 to 60%, the overcoat paint has a lower pigment weight concentration (PWC) than that of the undercoat paint, in the steps of applying the overcoat paint and wiping off a part of the applied overcoat paint, the overcoat paint having a different hue from the undercoat paint is applied and the position and the amount of the overcoat paint applied are varied to make differences in the depth of color among the wood board patterns of the building board; and the inorganic base material has on the upper surface thereof profile characteristics resembling a plurality of woodboards having a pronounced saw cut pattern.

2. The method for manufacturing a building board according to claim 1, wherein a portion in which an undercoat coating is seen through an overcoat coating is formed by the step of wiping off a part of the overcoat paint.

3. The method for manufacturing a building board according to claim 1, wherein the overcoat paint comprises a colored clear paint.

4. The method for manufacturing a building board according to claim 1, wherein a portion in which an overcoat coating is absent is formed by the step of wiping off a part of the overcoat paint.

5. The method for manufacturing a building board according to claim 1, wherein the overcoat paint comprises a paint that dries more slowly than the undercoat paint.

6. The method for manufacturing a building board according to claim 1, wherein the undercoat paint comprises a paint containing a filler.

7. The method for manufacturing a building board according to claim 1, wherein the inorganic base material is selected from the group consisting of a wood fiber-reinforced cement board, a fiber-reinforced cement board, a fiber-reinforced cement calcium silicate board, a slag gypsum board, a metal-based siding board, and an ALC board.

* * * * *